United States Patent [19]

Wize

[11] 3,969,789

[45] July 20, 1976

[54] DOOR HOLD-OPEN MECHANISM

[75] Inventor: Gary A. Wize, Washington, Mich.

[73] Assignee: General Motors Corporation, Detroit, Mich.

[22] Filed: May 27, 1975

[21] Appl. No.: 581,157

[52] U.S. Cl. ..... 16/145; 16/85

[51] Int. Cl.[2] ..... E05D 11/10

[58] Field of Search ..... 16/85, 145, 142, 82

[56] References Cited

UNITED STATES PATENTS

| | | | |
|---|---|---|---|
| 3,550,185 | 12/1970 | Marchione | 16/85 X |
| 3,820,192 | 6/1974 | Nakano | 16/145 |
| 3,889,316 | 6/1975 | Koike | 16/145 |
| 3,905,064 | 9/1975 | Brockhaus | 16/145 |

*Primary Examiner*—Andrew V. Kundrat
*Attorney, Agent, or Firm*—John P. Moran

[57] ABSTRACT

A door hold-open mechanism including a door hinge member and a body bracket member pivotally interconnected by a hinge pin, a hinge sector secured to the hinge member and having at least four door stop detent slots or pockets formed therein, a directional cam pivotally mounted on the hinge pin and frictionally connected to the hinge sector and having a pair of seats and an intermediate cam slot formed thereon adjacent the detent slots, a torque-rod mounted on the bracket member, a roller mounted on an end portion of the torque-rod and urged by the torque-rod into one of the four detent slots of the hinge member when the door is stopped and urged by an edge of the intermediate cam slot onto the adjacent seat of the directional cam while the door is in motion, overriding the detent slots until the door is once again stopped.

3 Claims, 7 Drawing Figures

DOOR HOLD-OPEN MECHANISM

This invention relates generally to door hinge mechanisms and, more particularly, to such mechanisms adapted to produce more than two door hold-open positions.

While present door hold-open mechanisms are generally satisfactory in operation, it is desirable to have such a mechanism which includes more than the usual two door hold-open positions, namely, fully open and open to some one intermediate position.

Accordingly, an object of the invention is to provide an improved door hold-open mechanism which is adapted to provide more than two door hold-open positions, and which moves smoothly through either the opening or closing arc to or from the selected positions, by-passing any intermediate available positions without contacting same.

Another object of the invention is to provide an improved door hold-open mechanism which includes four door stop detent slots adapted to provide one closed and three door hold-open positions, and including means for camming a roller out of any of the detent slots and carrying same past adjacent detent slots to a selected other open or closed position.

A further object of the invention is to provide a door hold-open mechanism including a hinge sector having four detent slots or pockets formed therein, a directional cam pivotally mounted adjacent the hinge section and having a cam slot with seats formed adjacent the edges thereof, a torque-rod having a roller rotatably mounted thereon and urged by the torque-rod into contact with one of the four detent slots when the door is stopped and urged by one or the other edges of the cam slot, depending upon the direction the door is being moved, onto the adjacent seat while the door is in motion, overriding the detent slots until the door is once again stopped, at which point a slight force thereagainst in the opposite direction causes the roller to drop off the seat and reenter the cam slot in the directional cam, as well as the nearest detent slot in the hinge sector.

These and other objects and advantages of the invention will be apparent when reference is made to the following description and accompanying drawings, wherein.

Figure 1:
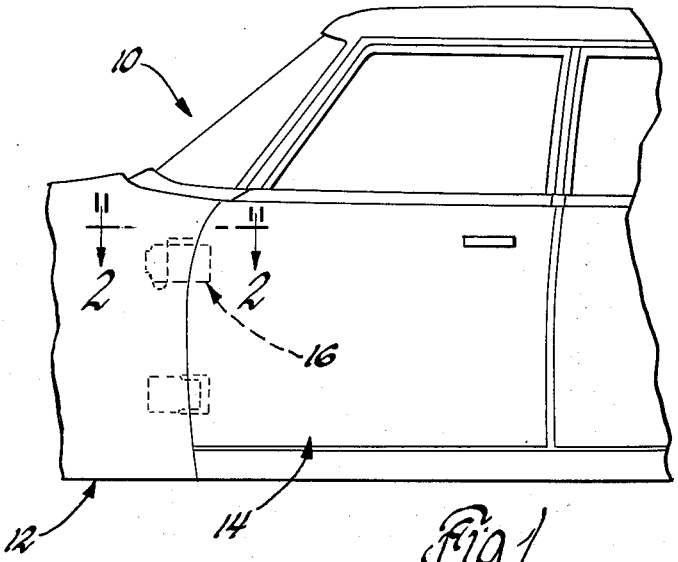
FIG. 1 is a fragmentary view of an automobile body and door embodying the invention.

Referring now to the drawings in greater detail, FIG. 1 illustrates an automobile 10 including a body 12 having a front door 14 mounted thereon. A door hold-open mechanism 16 includes a bracket member 18 (FIG. 3) secured by bolts 20 to an inner surface 22 (FIG. 2) of the body 12, and a hinge member 24 secured by bolts 26 to a leading edge 28 of the door 14.

Figure 3:
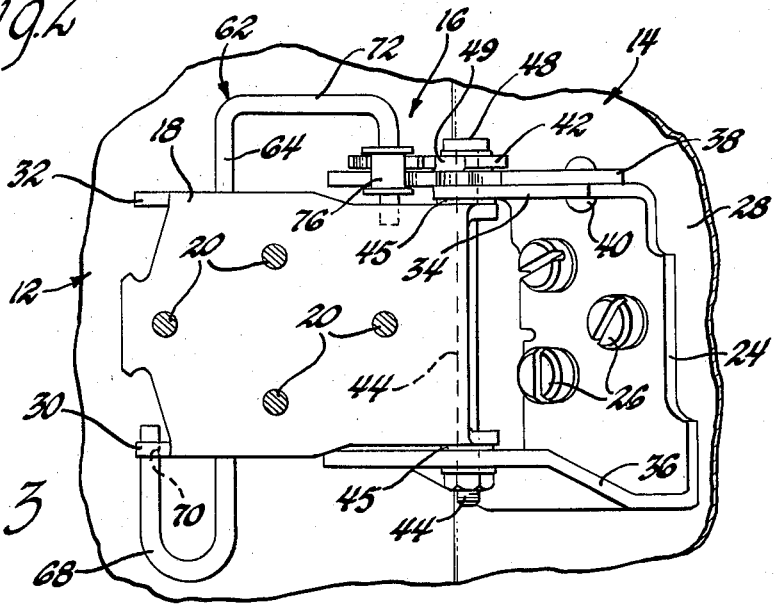
FIG. 3 is a cross-sectional view taken along the plane of line 3—3 of FIG. 2, and looking in the direction of the arrows.
Figure 4:
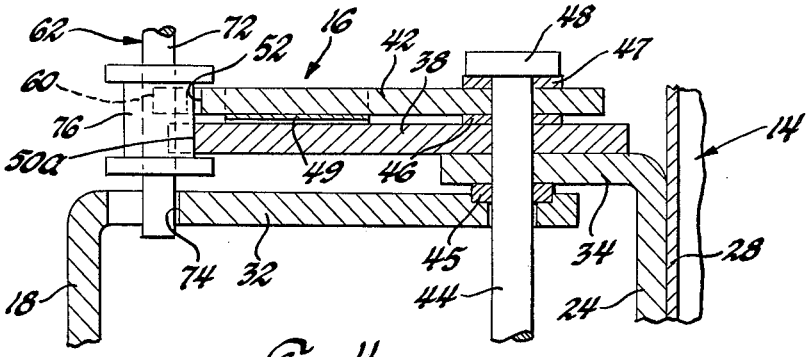
FIG. 4 is an enlarged view of a portion of the FIG. 3 structure, with portions thereof cut away.
Figure 5:
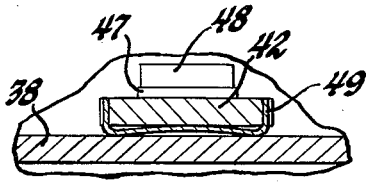
FIG. 5 is an enlarged fragmentary cross-sectional view taken along the plane of line 5—5 of FIG. 2, and looking in the direction of the arrows.

Side or anchor walls 30 and 32 are formed on oppositely disposed edges of the bracket member 18, extending perpendicularly away from the inner surface 22 of the body 12. Side walls 34 and 36 are formed on oppositely disposed edges of the hinge member 24, extending perpendicularly away from the leading door edge 28. A hinge sector 38 is secured by a rivet 40 to the outer surface of the side wall 34. A directional cam 42 is pivotally mounted on the outer surface of the hinge sector 38 by a hinge pin 44 extending through each of the directional cam 42, the hinge sector 38, and the side walls 34 and 32, and thence through the other side walls 30 and 36. Bronze bushings 45 are mounted around the hinge pin 44 between respective adjacent side walls 30 and 36, and 32 and 34 (FIG. 3). First and second flat washers 46 and 47 are mounted around the hinge pin 44, between the hinge sector 38 and the directional cam 42 and between the directional cam 42 and the head 48 of the hinge pin 44, respectively. A friction-spring 49 (FIG. 5) is mounted on the directional cam 42 and compressed between the directional cam 42 and the hinge sector 38.

Figure 6:
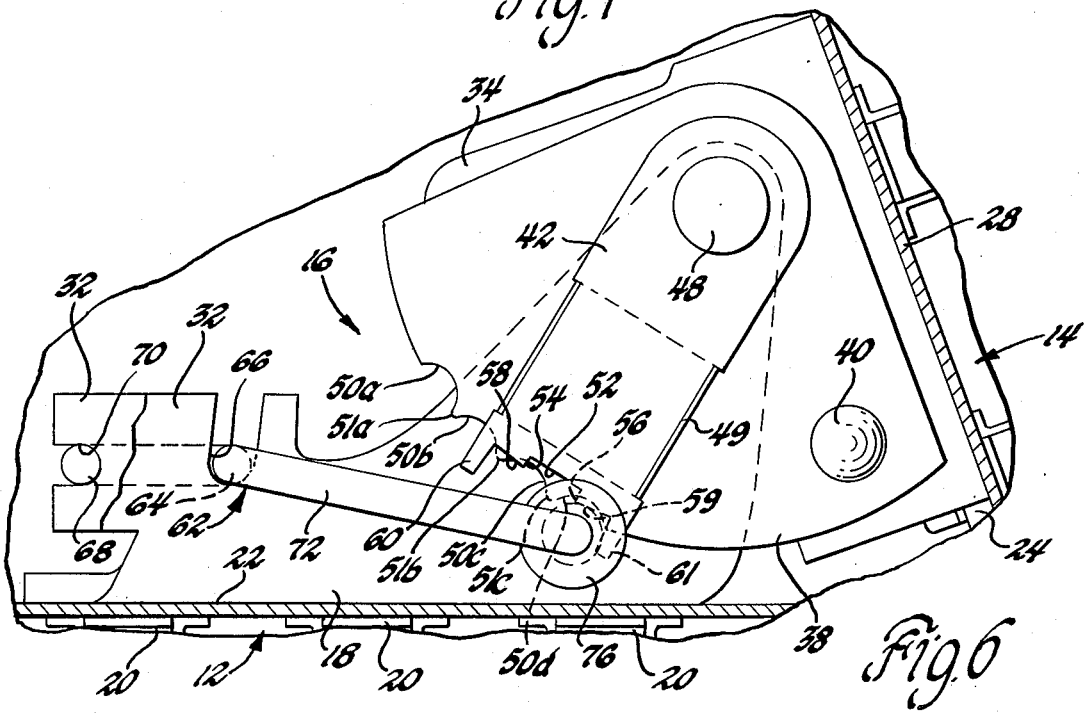
FIGS. 6 and 7 are enlarged fragmentary views of portions of the FIG. 2 structure in different operative positions.
Figure 7:
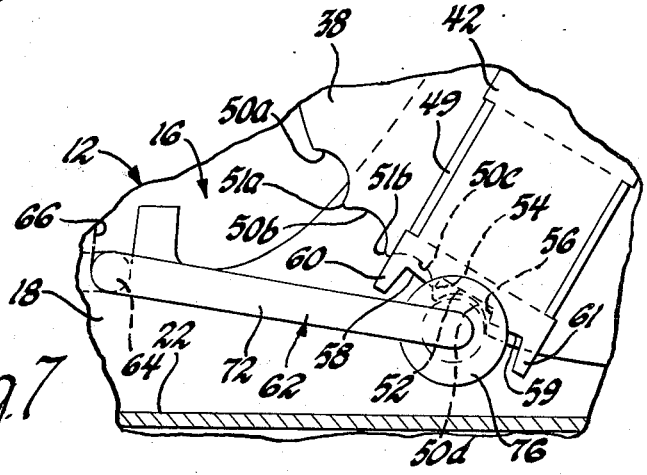

As best shown in FIGS. 6 and 7, four (4) arcuate-shaped detent slots or pockets 50*a*, 50*b*, 50*c*, and 50*d*, with respective intermittent peaks 51*a*, 51*b*, and 51*c*, are formed in the outer arcuate edge of the hinge sector 38. A rectangular-shaped cam slot 52 is formed in the center of the outer edge of the directional cam 42. A pair of seats are formed adjacent the respective edges 54 and 56 of the cam slot 52, the seats consisting of shelves 58 and 59 and respective retainer walls 60 and 61.

A torque-rod 62 includes a straight central portion 64 extending across both anchor walls 30 and 32, retained therethrough by aligned slots 66 formed in the anchor walls 30 and 32. A first U-shaped end-portion 68 is formed on one end of the straight central portion 64, terminating in a slot 70 formed in the anchor wall 30. A second U-shaped end-portion 72 is formed on the other end of the straight central portion 64, terminating in an elongated opening 74 formed in the anchor wall 32. A torque-rod roller 76 is rotatably mounted on the free end of the second U-shaped end-portion 72 so as to be urged by the torque-rod 62 into some one of the arcuate-shaped detent pockets 50 of the hinge sector 38 and/or into the cam slot 52 of the directional cam 42.

OPERATION

Figure 2:
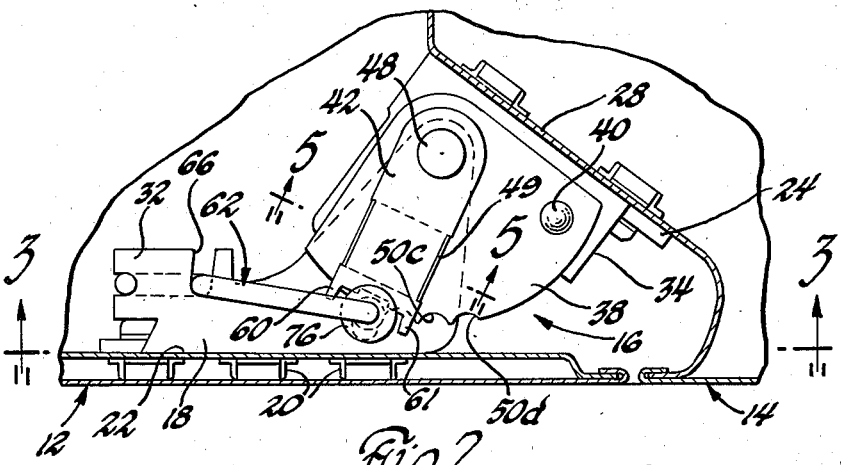
FIG. 2 is an enlarged fragmentary cross-sectional view taken along the plane of line 2—2 of FIG. 1, and looking in the direction of the arrows.

FIG. 2 illustrates the door 14 in its closed position, i.e., with the roller 76 urged by the torque-rod 62 into the detent pocket 50*a* of the door hinge sector 38 and into the cam slot 52 of the directional cam 42. Once the door 14 starts to open, the hinge sector 38 and, due to the drag of the compressed friction-spring 49, the directonal cam 42, as well, will be caused to rotate in a clockwise direction with respect to the roller 76 (FIG. 6). This causes the edge 56 of the cam slot 52 to contact the roller 76 and nudge the roller 76 outwardly with respect to the pocket 50*a*, onto the seat formed by the shelf 59 and the retainer wall 61 (FIG. 6). Thereafter, while the door 14 is in motion, the roller 76 will be carried on the seat 59/61 over the peaks and detent pockets until the door is stopped. Once stopped, any slight reverse force on the door 14 will cause the directional cam 42 to move in a counterclockwise direction relative to the roller 76, causing the latter to move from the seat 59/61 and to snap back into the cam slot 52 and, hence, into the nearest detent pocket 50*b*, 50*c*, or 50*d* of the door hinge sector 38, where it is retained until the door is again put into motion. Thus, the door 14 may be selectively moved from closed position 50*a* to any one of three predetermined open positions 50*b*, 50*c*, and 50*d*, FIG. 7 illustrating the fully open door positon, i.e., with the roller 76 located in the detent pocket 50*d*.

To completely close the door 14, or to move it to one of the more progressively closed positions, the initial movement of the door 14 toward the body 12 will cause the outer edge 54 of the cam slot 52 formed in the directional cam 42 to contact the roller 76 and nudge it out of both the cam slot 52 and the particular pocket 50*d*, 50*c*, or 50*b* then in use, for example, 50*d* of FIG. 7, and cause the roller 76 to be lifted onto the seat formed by the shelf 58 and the adjacent retainer wall 60 and carried back over the peaks and detent pockets until movement of the door 14 is stopped. Again, any slight force on the door 14 in the opposite direction urges the roller 76 off the seat 58/60, back into the cam slot 52 and, hence, into the nearest detent pocket 50*c*, 50*b*, or 50*a* of the door hinge sector 38, for example, 50*a* of FIG. 2.

It should be apparent that the invention provides a door hold-open mechanism having more than the usual two hold-open positions, while effectively eliminating any substantial "whip" of the door into a selected position.

While but one embodiment of the invention has been shown and described, other modifications thereof are possible.

I claim:

1. In a door hinge mechanism mounted between an automotive door edge and a rigid body portion adjacent thereto, the improvement comprising a hinge member secured to said door edge, a bracket secured to said rigid body portion, a hinge pin mounted through portions of said hinge member and said bracket, a hinge sector secured to said hinge member, a plurality of detent slots formed along an edge of said hinge sector, a directional cam pivotally mounted adjacent said hinge sector, a cam slot formed in an edge of said directional cam, first and second shoulders forming opposite corners of said cam slot, first and second seats formed adjacent said first and second shoulders, respectively, a torque-rod secured at one end thereof to said bracket, and a roller rotatably mounted on said torque-rod adjacent the other end thereof and urged thereby into contact with one of said plurality of detent slots when the door is stopped and urged by one of said first and second shoulders onto one of said first and second seats, respectively, when the door is set in motion, overriding said detent slots until the door is once again stopped, after which any slight reverse force thereagainst causes said roller to snap back into said cam slot and the nearest of said detent slots.

2. In a door hinge mechanism mounted between an automotive door edge and a rigid body portion adjacent thereto, the improvement comprising a hinge member secured to said door edge, a bracket secured to said rigid body portion, overlapping wall members formed on said hinge member and said bracket, a hinge sector secured to one of said overlapping wall members, a plurality of arcuate pockets formed along an edge of said hinge sector, a directional cam pivotally mounted on one of said overlapping wall members adjacent said hinge sector, frictional means mounted between said hinge sector and said directional cam, a slotted pocket formed in an edge of said directional cam, first and second shoulders forming opposite corners of said slotted pocket, first and second seats formed adjacent said first and second shoulders, respectively, a torque-rod secured at one end thereof to one of said overlapping wall members of said bracket, and a roller rotatably mounted on said torque-rod adjacent the other end thereof and urged by said torque-rod into contact with one of said plurality of arcuate pockets and/or into said slotted pocket or urged by one of said first and second shoulders onto the seat adjacent thereto in response to a manually-actuated opening or closing directional movement of said door.

3. In a door hinge mechanism mounted between an automotive door edge and a rigid body portion adjacent thereto, the improvement comprising a hinge member secured to said door edge, a bracket secured to said rigid body portion, first and second pairs of side walls formed on respective oppositely disposed side walls of said hinge member and said bracket, a hinge pin mounted through said first and second pairs of side walls, a hinge sector secured to one of said first pair of said side walls, a plurality of arcuate-shaped pockets formed along an edge of said hinge sector, a directional cam pivotally mounted on said hinge pin adjacent said hinge sector, a friction spring mounted between said hinge sector and said directional cam, a cam slot formed in an edge of said directional cam, first and second shoulders forming opposite corners of said cam slot, first and second seats formed adjacent said first and second shoulders, respectively, a torque-rod having a straight central portion extending across said second pair of side walls and having oppositely disposed U-shaped end portions formed thereon, one of said U-shaped end portions being secured in one of said second pair of side walls and the other of said U-shaped end portions extending past said edges of said hinge member and said directional cam and being freely mounted in an elongated opening formed in the other of said second pair of side walls, and a roller rotatably mounted on said other of said U-shaped end portions and urged by said torque-rod into contact with one of said plurality of arcuate-shaped pockets and/or into said cam slot or urged by one of said first and second shoulders against the force of said torque-rod onto one of said first and second seats, respectively, in response to the initial manual movement of said door toward an opening or closing direction.

* * * * *